US008490959B2

(12) United States Patent
Sakurai

(10) Patent No.: US 8,490,959 B2
(45) Date of Patent: Jul. 23, 2013

(54) SHEET PROCESSING APPARATUS, IMAGE FORMING SYSTEM AND SHEET PROCESSING METHOD

(75) Inventor: Yuuki Sakurai, Shizuoka-ken (JP)

(73) Assignees: Kabushiki Kaisha Toshiba, Tokyo (JP); Tohsiba Tec Kabushiki Kaisha, Tokyo (JP)

( * ) Notice: Subject to any disclaimer, the term of this patent is extended or adjusted under 35 U.S.C. 154(b) by 19 days.

(21) Appl. No.: 13/338,471

(22) Filed: Dec. 28, 2011

(65) Prior Publication Data

US 2012/0190525 A1 Jul. 26, 2012

Related U.S. Application Data

(60) Provisional application No. 61/435,547, filed on Jan. 24, 2011.

(30) Foreign Application Priority Data

Feb. 25, 2011 (JP) ..... P2011-039307

(51) Int. Cl.
*B31F 1/10* (2006.01)

(52) U.S. Cl.
USPC ..... 270/45; 270/32; 270/58.07

(58) Field of Classification Search
USPC ..... 270/32, 45, 51, 58.07; 493/406, 493/407
See application file for complete search history.

(56) References Cited

U.S. PATENT DOCUMENTS

| | | | | |
|---|---|---|---|---|
| 6,905,118 | B2 * | 6/2005 | Yamada et al. | 270/8 |
| 2012/0025439 | A1 * | 2/2012 | Yahata et al. | 270/58.07 |
| 2012/0028780 | A1 * | 2/2012 | Sugiyama et al. | 493/454 |

FOREIGN PATENT DOCUMENTS

| | | |
|---|---|---|
| JP | 3732812 | 1/2006 |
| JP | 3746472 | 2/2006 |

* cited by examiner

*Primary Examiner* — Leslie A Nicholson, III
(74) *Attorney, Agent, or Firm* — Patterson & Sheridan, L.L.P.

(57) ABSTRACT

According to one embodiment, a sheet processing apparatus includes a roller unit having a reinforce roller which moves along a fold of a sheet perpendicular to the sheet conveying direction and thereby further reinforces the fold by the reinforce roller, and a control unit which counts the number of halts of the roller unit generated during the reinforcing operation of the sheet, and in case that the counted number of the halts of the roller unit is less than a prescribed number of times, makes the roller unit to be moved to a retract position and then makes the roller unit to be driven again to perform the reinforcing operation.

20 Claims, 19 Drawing Sheets

SHEET PROCESSING APPARATUS, IMAGE FORMING SYSTEM AND SHEET PROCESSING METHOD

CROSS-REFERENCE TO RELATED APPLICATION

This application is based upon and claims the benefit of priority from the prior U.S. Patent Application No. 61/435,547, filed on Jan. 24, 2011, the entire contents of which are incorporated herein by reference.

This application is also based upon and claims the benefit of priority from the prior Japanese Patent Application No. 2011-039307, filed on Feb. 25, 2011, the entire contents of which are incorporated herein by reference.

FIELD

Exemplary embodiments described herein relate to a sheet processing apparatus, an image forming system and a sheet processing method provided with a processing function, such as, a reinforcing function.

BACKGROUND

A sheet processing apparatus is known which makes a reinforce roller to be moved to a home position and displays an indication to urge jam processing on a display means in case that some sort of abnormality is sensed and a reinforcing operation is halted during the reinforcing operation in a saddle unit having a reinforcing unit.

However, even if the reinforcing operation halts, the jam processing is not necessarily required. In case that the reinforcing operation halts with the load generated by thick sheets, it is only necessary to perform the reinforcing operation again without performing the jam processing. That is, every time the reinforcing operation halts, to display an error indication for urging the jam processing and to make a user confirm the indication may urge the user to do an unnecessary work and thereby may be a burden to the user.

DETAILED DESCRIPTION

In general, according to one embodiment, there is provided a sheet processing apparatus including: a roller unit having a reinforce roller which moves along a fold of a sheet perpendicular to the sheet conveying direction and thereby further reinforces the fold by the reinforce roller; and a control unit which counts the number of halts of the roller unit generated during the reinforcing operation of the sheet, and in case that the counted number of the halts of the roller unit is less than a prescribed number of times, makes the roller unit to be moved to a retract position and then makes the roller unit to be driven again to perform the reinforcing operation.

Hereinafter, embodiments of a sheet processing apparatus will be described with reference to the accompanied drawings.

First Embodiment

Figure 1:
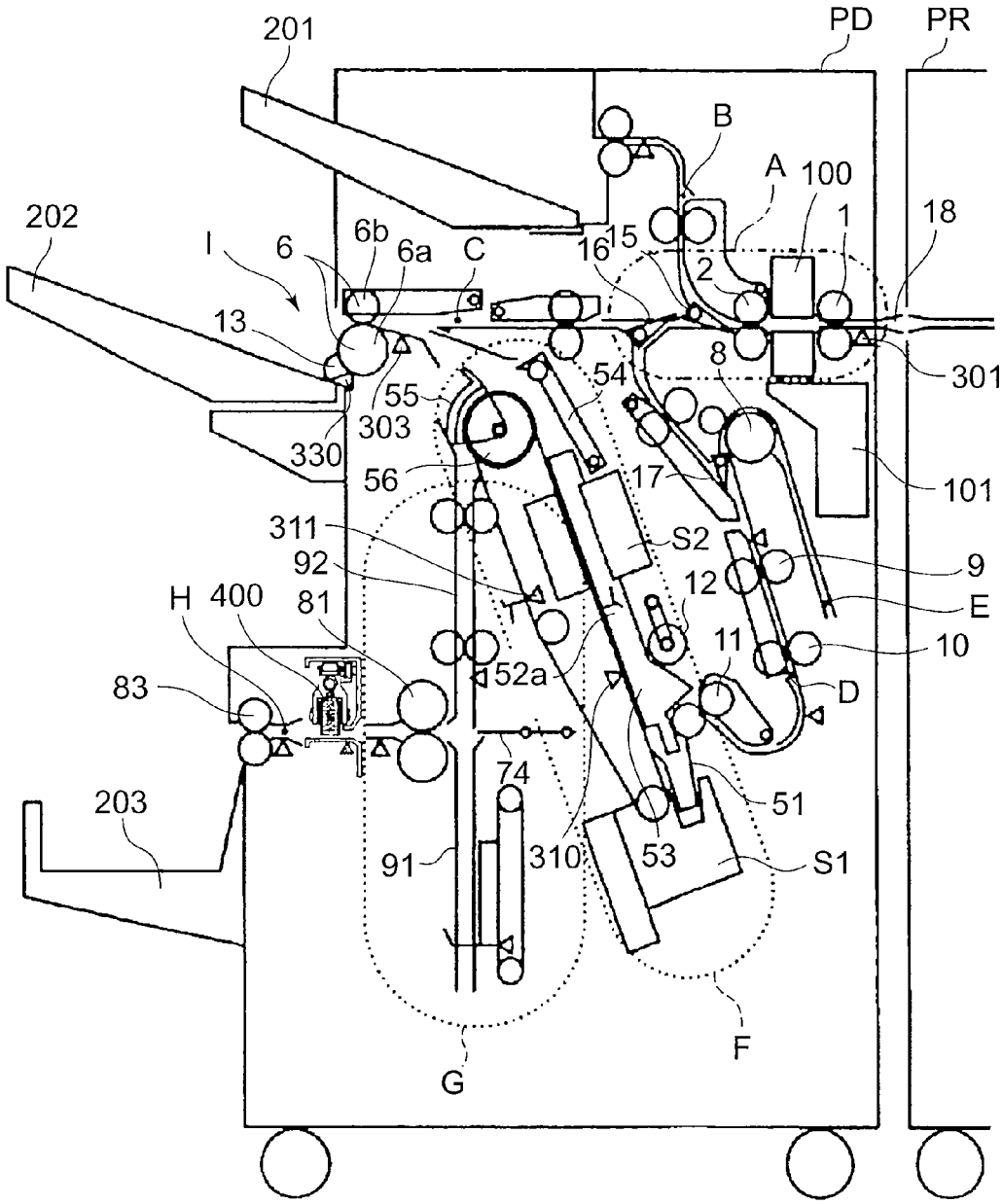
FIG. 1 is a view showing an image forming system to which an embodiment is applied.

A first embodiment will be described using FIG. 1 to FIG. 16. FIG. 1 is a sectional view showing a finisher PD as a sheet processing apparatus to which a first embodiment is applied and a part of an image forming apparatus PR. The finisher PD and the image forming apparatus PR are collectively referred to as an image forming system.

In FIG. 1, the finisher PD is fixed to the image forming apparatus PR. A recording medium discharged from a sheet discharge port of the image forming apparatus PR is lead to an inlet 18 of the finisher PD. Here, the recording medium is a sheet. A sheet passes through a path A having finishing means for finishing the sheet, and then is sorted by path selectors 15, 16 into any one of a path B for leading the sheet to an upper tray 201, a path C for leading the sheet to a shift tray 202, a path D for leading the sheet to a processing tray F (hereinafter referred to also as a staple tray) which aligns, staples or otherwise processes the sheet or sheets.

The sheets which have been led to the staple tray F through the paths A and D and then have been aligned and stapled in the staple tray F are sorted by a guide plate 54 and a movable guide 55 that composes deflecting means into the path C for leading the sheet to the shift tray 202 and a processing tray G (hereinafter referred to also as a fold processing tray) which folds or otherwise processes the sheets. The sheets which have been folded or otherwise processed in the fold processing tray G are further strongly folded by a reinforce roller unit 400, and then are lead to a lower tray 203 through a path H. In addition, a path selector 17 is arranged in the path D, and is kept in the state shown in FIG. 1 by a low load spring. After the back end of the sheet passes through the path selector 17, at least a conveying roller 9 out of the conveying rollers 9, 10 and a staple outlet roller 11, and a refeed roller 8 are rotated in the reverse direction to thereby lead the back end thereof to a prestacking portion E and to cause the sheet to stay there, and the sheet is conveyed together with the next sheet superposed thereon. Such an operation like this is repeated and thereby two or more sheets can also be conveyed in the superposed state.

On the path A which is mutual to the paths B, C, D, an inlet sensor 301 to sense the sheet received from the image forming apparatus PR is arranged at the upstream side, and at the downstream side thereof an input roller pair 1, a punch unit 100, a waste hopper 101, a conveying roller pair 2, the path selectors 15, 16 are sequentially arranged. The path selectors 15, 16 are kept in the state shown in FIG. 1 by springs, and when their solenoids are turned ON, the path selector 15 rotates upward and the path selector 16 rotates downward to thereby sort the sheet into one of the paths B, C, D.

The finisher PD selectively performs punching (the punch unit 100), jogging and edge stapling (jogger fences 53 and an edge stapler S1), jogging and center stapling (the jogger fences 53 and center staplers S2), sorting (the shift tray 202) or center folding (a fold plate 74, a fold roller pair 81 and the reinforce roller unit 400) for a sheet or sheets.

Figure 2:
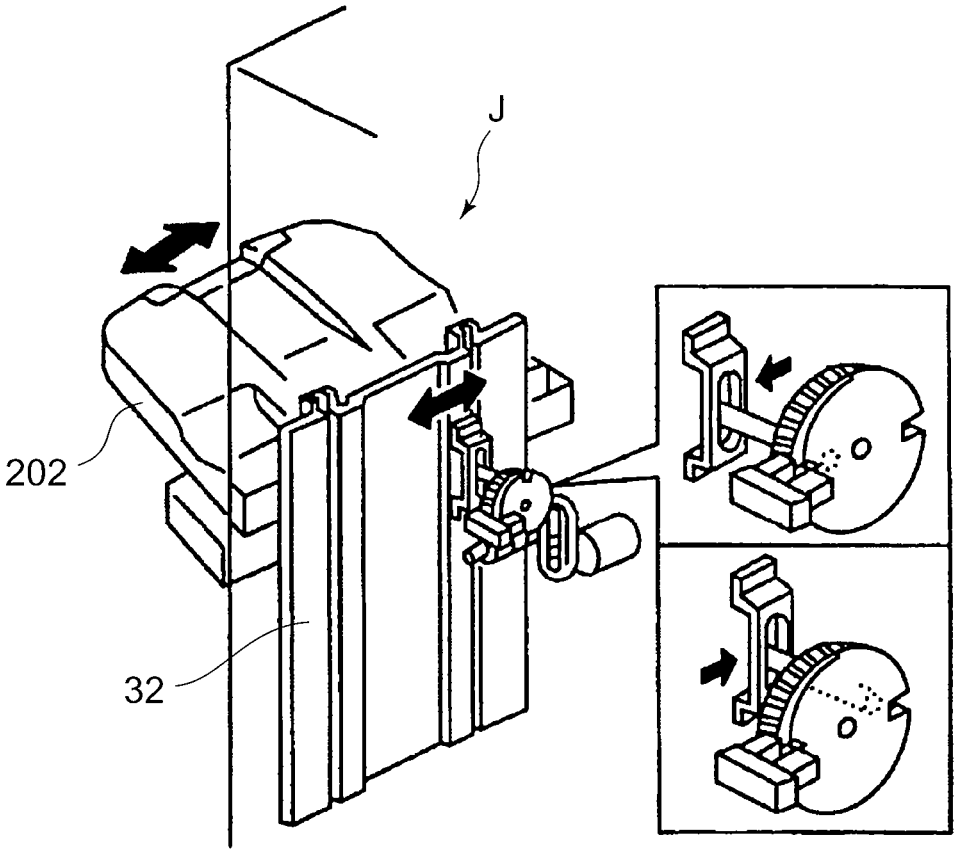
FIG. 2 is a perspective view showing a shifting mechanism to which the embodiment is applied.
Figure 3:
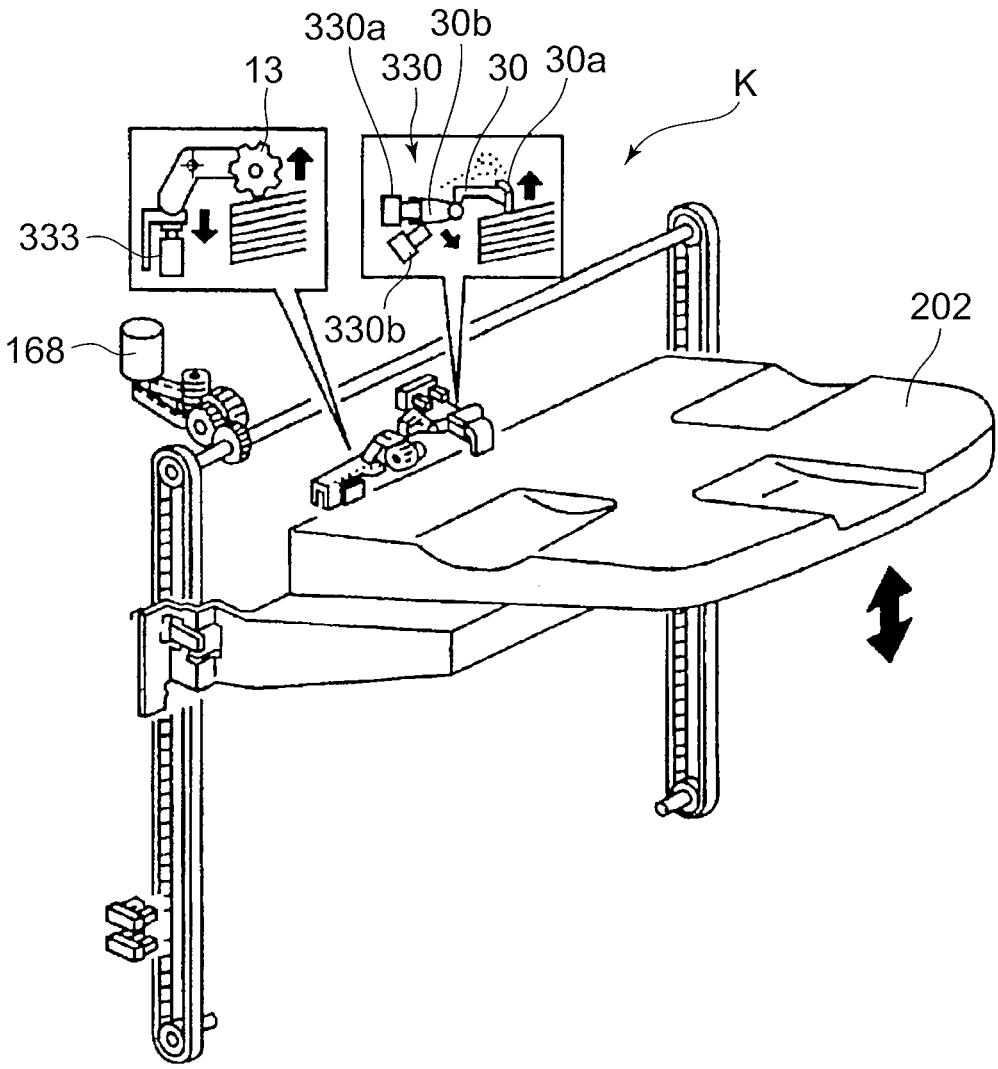
FIG. 3 is a perspective view showing a shift tray elevating mechanism to which the embodiment is applied.

A shift tray outlet section I which is located at the most downstream position of the finisher PD includes shift outlet rollers 6, a return roller 13, a sheet surface sensor 330, the shift tray 202, a shifting mechanism J shown in FIG. 2 and a shift tray elevating mechanism K shown in FIG. 3. FIG. 2 is an enlarged perspective view of the main portion indicating the shifting mechanism J, and FIG. 3 is an enlarged perspective view of the main portion of the shift tray elevating mechanism K.

In FIGS. 1 and 3, the return roller 13 makes contact with a sheet discharged from the shift outlet rollers 6 and causes the back end of the sheet to abut against an end fence 32 shown in FIG. 2 for thereby aligning it. The return roller 13 is caused to be rotated by the rotation force of the shift outlet rollers 6. A limit switch 333 is arranged in the vicinity of the return roller 13, and when the shift tray 202 is lifted to raise the return roller 13, the limit switch 333 turns ON to cause a tray motor 168 to stop rotating. This prevents the shift tray 202 from overrunning. Furthermore, as shown in FIG. 1, the sheet surface sensor 330 is provided as a sheet surface sensing means which senses a sheet surface position of a sheet or a sheet stack discharged out on the shift tray 202.

As shown in FIG. 3, the sheet surface censor 330 has a lever 30, a sheet surface sensor 330*a* (for stapling use) and a sheet surface sensor 330*b* (for non-stapling use). The lever 30 rotates around its shaft portion and has a contact end 30*a* which makes contact with the top of the back end of a sheet loaded on the shift tray 202 and a sectorial interrupter 30*b*.

When the sheet surface sensor 330*a* (for stapling use) and the sheet surface sensor 330*b* (for non-stapling use) sense that sheets are stacked on the shift tray 202 to a prescribed height, the tray motor 168 is driven to lower the shift tray 202 by a prescribed amount. The sheet surface position of the sheet stack on the shift tray 202 is therefore maintained at a substantially constant height.

Figure 4:
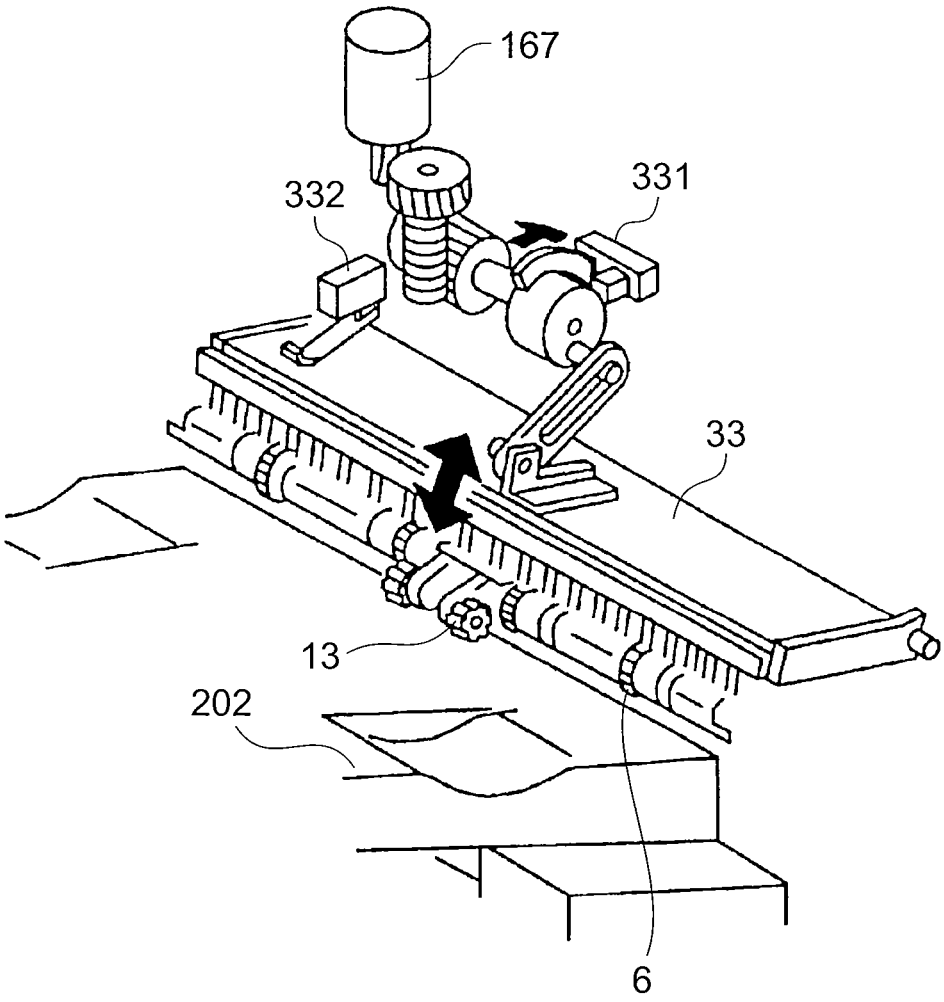
FIG. 4 is a perspective view showing an outlet section to the shift tray to which the embodiment is applied.

FIG. 4 is a perspective view showing a construction of the outlet section I to the shift tray 202.

In FIGS. 1 and 4, the shift outlet roller 6 has a drive roller 6*a* and a driven roller 6*b*. A guide plate 33 is supported at its upstream side in the sheet discharge direction and is supported swingably in the up-and-down direction. The driven roller 6*b* is rotatably supported to the free end of the guide plate 33. The driven roller 6*b* makes contact with the drive roller 6*a* due to its own weight or a biasing force, and a sheet is nipped between both the rollers 6*a*, 6*b* and is discharged.

When a stapled sheet stack is to be discharged, the guide plate 33 is lifted upward and then lowered at a prescribed timing. This timing is determined on the basis of a sensing signal of a shift outlet sensor 303. Its stop position is determined on the basis of a sensing signal of a guide plate sensor 331, and the guide plate 33 is driven by a guide plate motor 167. In addition, the guide plate motor 167 is controlled to be driven in accordance with the ON/OFF state of a limit switch 332.

A construction of the staple tray F for stapling will be described.

Figure 5:
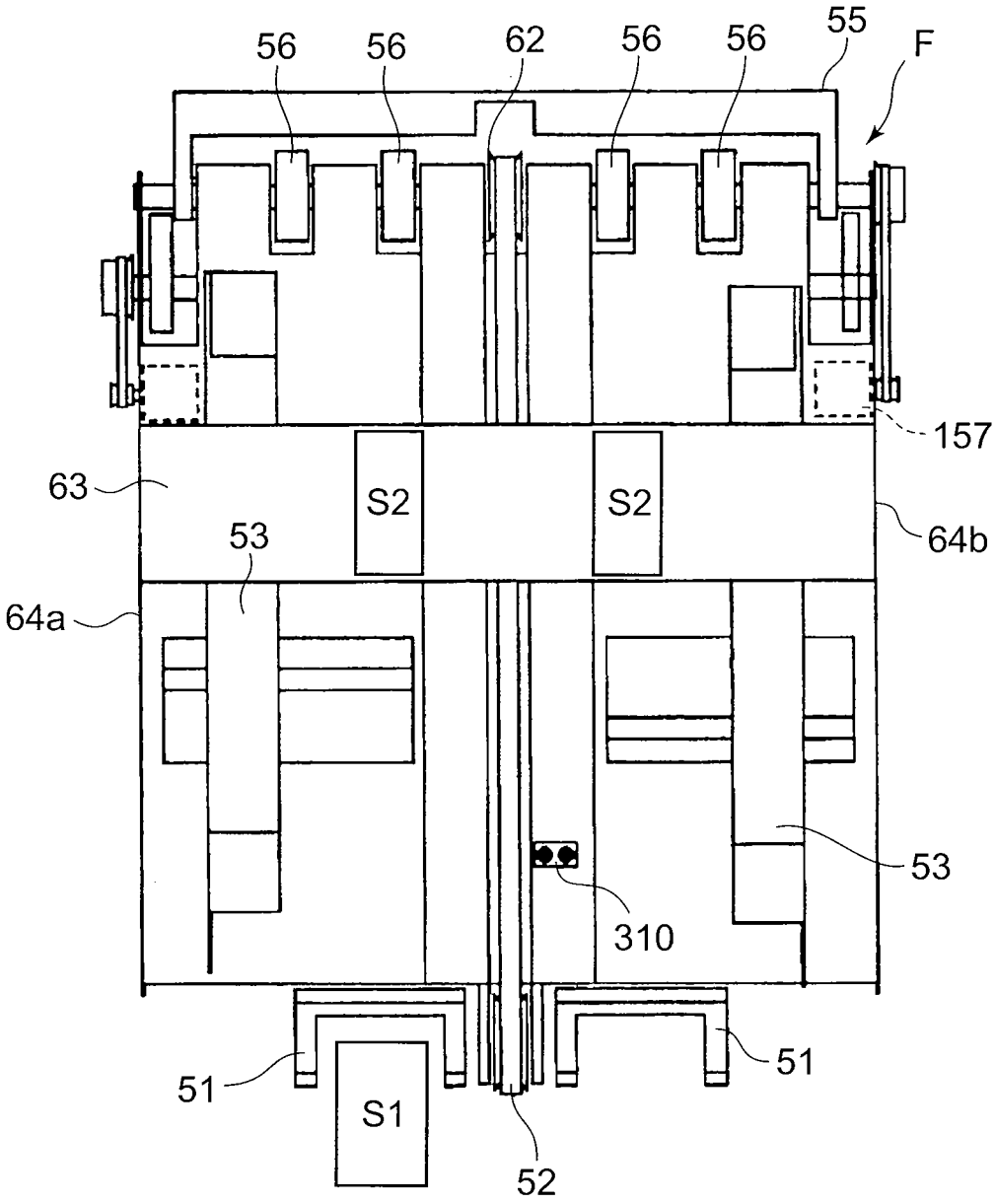
FIG. 5 is a plan view of a staple processing tray to which the embodiment is applied as seen from a direction perpendicular to a sheet conveying plane.
Figure 6:
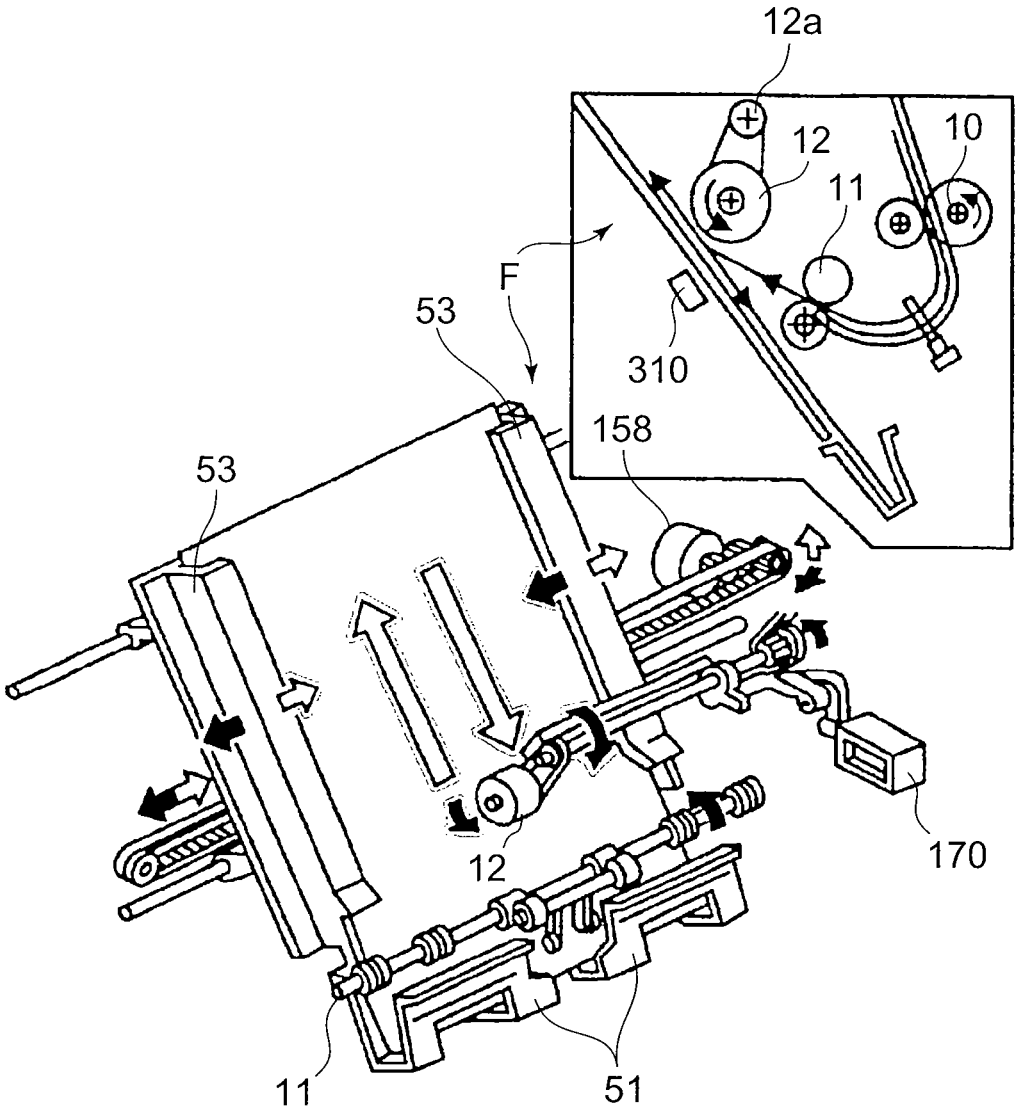
FIG. 6 is a perspective view showing the staple processing tray and its drive mechanism to which the embodiment is applied.
Figure 7:
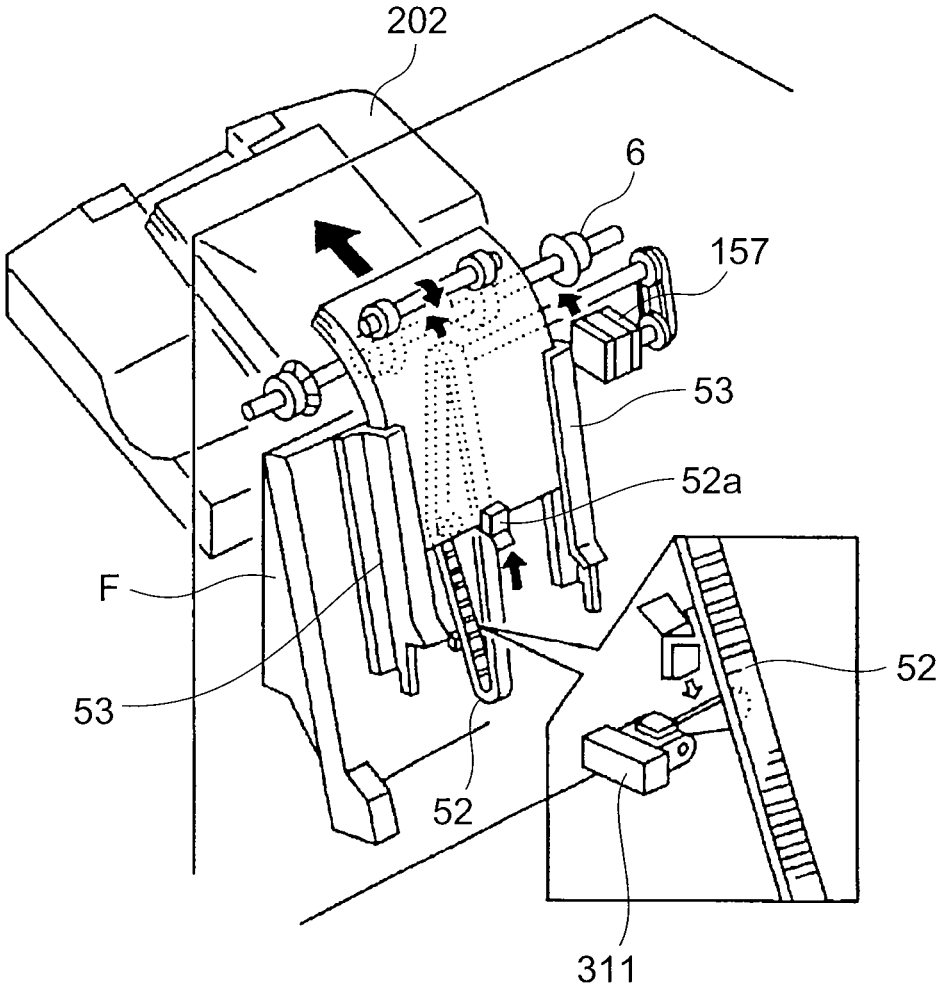
FIG. 7 is a perspective view showing a discharge mechanism of a sheet stack to which the embodiment is applied.

FIG. 5 is a plan view of the staple tray F as seen from the direction perpendicular to the sheet conveying plane, FIG. 6 is a perspective view showing the staple tray F and its driving mechanism, and FIG. 7 is a perspective view showing a sheet stack discharging mechanism. To begin with, as shown in FIG. 6, sheets which are led to the staple tray F by the staple outlet roller 11 are sequentially stacked on the staple tray F.

In this case, a knock roller 12 aligns every sheet in the longitudinal direction (a sheet conveying direction), while jogger fences 53 aligns the sheet in the lateral direction (a direction perpendicular to the sheet conveying direction, sometimes referred to as a sheet width direction). Between consecutive jobs, i.e., during an interval from the last sheet of a sheet stack to the first sheet of the next sheet stack, an edge stapler S1 (refer to FIG. 5) is driven by a staple signal from a control unit to thereby perform a stapling operation. The sheet stack which has been stapled is immediately conveyed to the shift outlet roller 6 by a discharge belt 52 with hooks 52*a* (refer to FIG. 7) and is discharged to the shift tray 202 which is set at a receiving position.

As shown in FIG. 7, the a home position of the hook 52*a* is sensed by an HP sensor 311, and the HP sensor 311 is turned ON/OFF by the hook 52*a* provided on the discharge belt 52. Two hooks 52*a* are arranged at spaced face-to-face positions on the outer circumference of the discharge belt 52, and alternately move and convey the sheet stacks housed on the staple tray F. In addition, the discharge belt 52 can be rotated in the reverse direction such that one hook 52*a* held in a stand-by position so as to move the sheet stack and the back face of the other hook 52*a* at the opposite side align the leading end of the sheet stack housed in the staple tray F in the sheet conveying direction, as needed. The hooks 52*a* function as an aligning means of the sheet stack in the sheet conveying direction at the same time.

As shown in FIG. 5, discharge rollers 56 are arranged and fixed on a drive shaft of the discharge belt 52 which is driven by a discharge motor 157 at the alignment center in the sheet width direction in a symmetrical arrangement with the discharge belt 52 and its drive pulley 62. In addition, the circumferential speed of these discharge rollers 56 is set higher than the circumferential speed of the discharge belt 52.

As shown in FIG. 6, a solenoid 170 causes the knock roller 12 to move about a fulcrum 12*a* in a pendulum fashion, so that the knock roller 12 intermittently acts on the sheet transferred to the staple tray F and causes the sheet to abut against rear fences 51. The jogger fences 53 are driven by a jogger motor 158 rotatable in the forward and reverse directions via a timing belt, and move back and forth in the sheet width direction.

Figure 8:
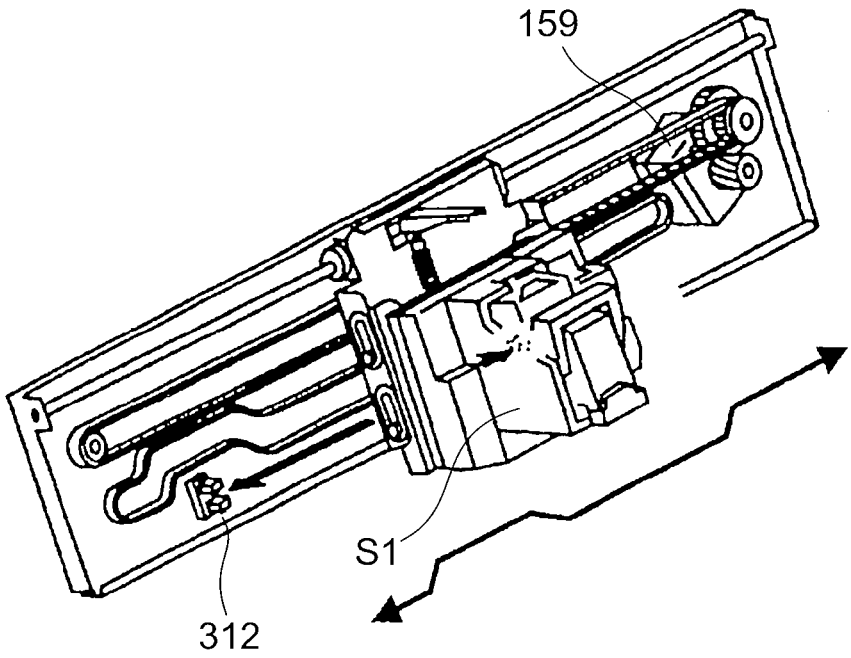
FIG. 8 is a perspective view showing an edge stapler and its drive mechanism to which the embodiment is applied.

In FIG. 8, the edge stapler S1 is driven by a stapler motor 159 which is rotatable in the forward and reverse directions via a timing belt, and moves in the sheet width direction in order to staple a sheet stack at a prescribed position of the sheet end portion. A stapler HP sensor 312 to sense the home position of the edge stapler S1 is provided at one end of the movable range of the edge stapler S1, and the stapling position in the sheet width direction is controlled in terms of the displacement of the edge stapler S1 from the home position.

Figure 9:
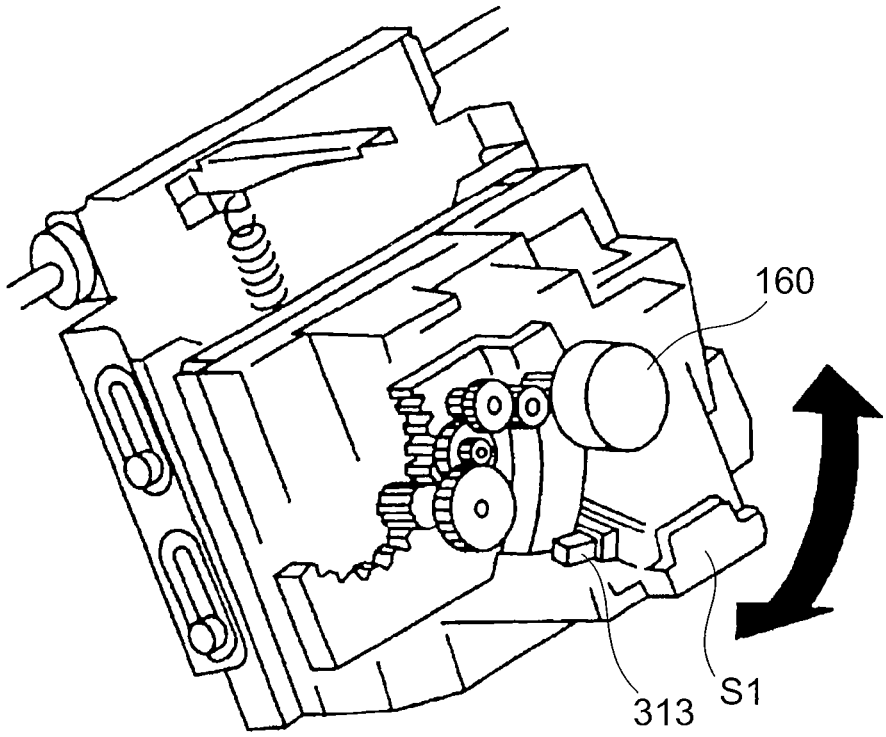
FIG. 9 is a perspective view showing an obliquely rotating mechanism of the stapler to which the embodiment is applied.

As shown in the perspective view of FIG. 9, the edge stapler S1 is constructed so that a striking angle of a staple can be selectively set in parallel to or obliquely to the edge portion of the sheet, and so that only the stapling mechanism portion of the edge stapler S1 is rotated by a prescribed angle obliquely at the home position so as to change staples easily. An arrow shown in FIG. 9 indicates a moving direction of the edge stapler S1. The edge stapler S1 is rotated obliquely by an oblique motor 160, and when a staple changing position sensor 313 senses that the stapling mechanism has reached a prescribed oblique angle or a staple changing position, the oblique motor 160 stops. After oblique stapling is finished or the replacement of staples is finished, the stapling mechanism is rotated to the original position to prepare for next stapling.

As shown in FIGS. 1 and 5, the center staplers S2 are arranged by two and symmetrically to the alignment center to each other in the sheet width direction, and are fixed to a stay 63. The center staplers S2 are arranged respectively at positions where the distance from the rear fences 51 to stapling positions of the center staplers S2 is not less than a distance corresponding to one-half of the length of the maximum sheet size that can be center stapled, as measured in the conveying direction.

In the case of center stapling, after a sheet stack is aligned by the jogger fences 53 in the direction perpendicular to the sheet conveying direction and is aligned by the rear fences 51 and the knock roller 12 in the sheet conveying direction, the discharge belt 52 is driven to lift the back end portion of the sheet stack with its hook 52*a* to a position where the center portion of the sheet stack in the sheet conveying direction coincides with the stapling positions of the center staplers S2. The discharge belt 52 stops at this position to staple the sheet stack by the center staplers S2. The stapled sheet stack is conveyed to the fold processing tray G side and is folded at the center.

In FIG. 5, a symbol 64*a* is a front side wall, 64*b* is a rear side wall, and a symbol 310 is a sheet sensor to sense the existence or non existence of the sheets on the staple tray F.

Figure 10:
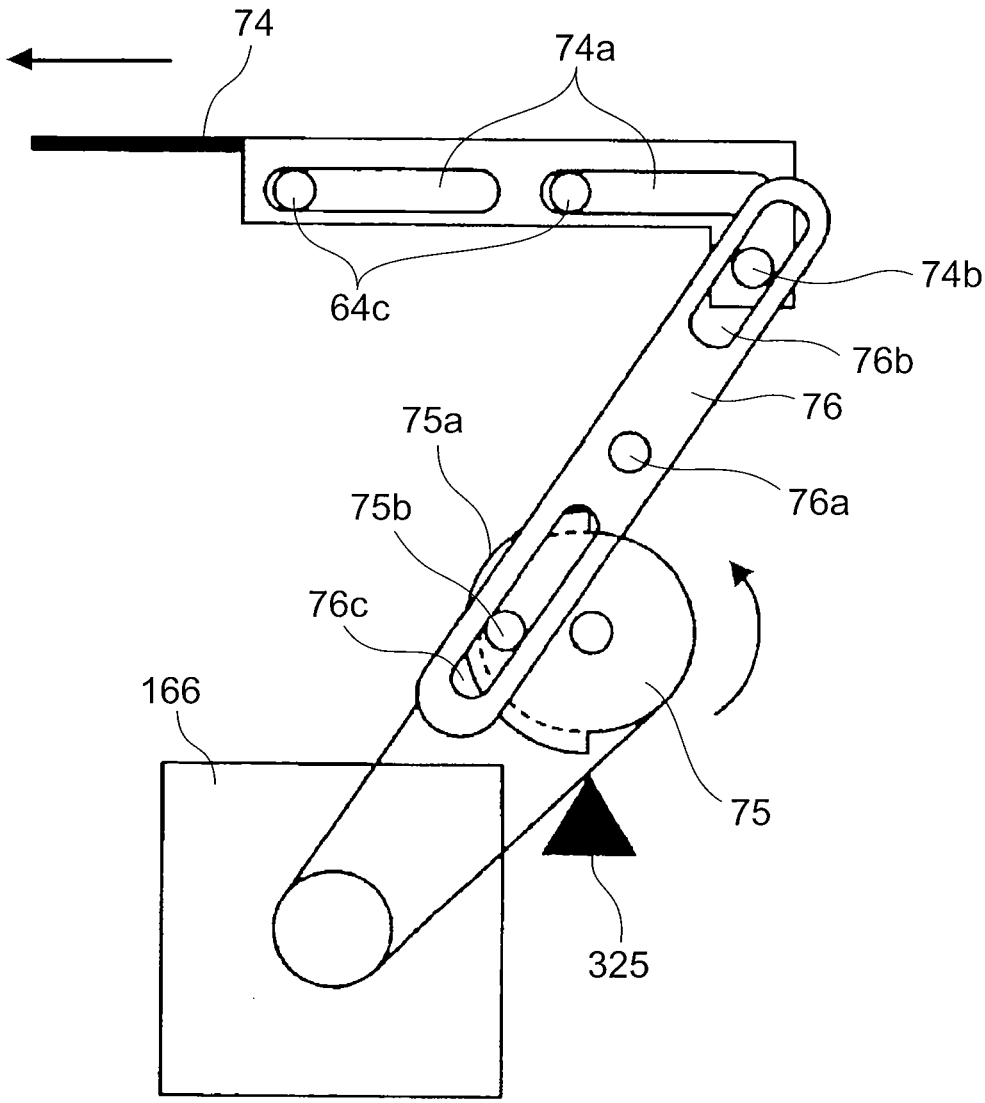
FIG. 10 is a view to describe an operation of a moving mechanism of a fold plate to which the embodiment is applied.
Figure 11:
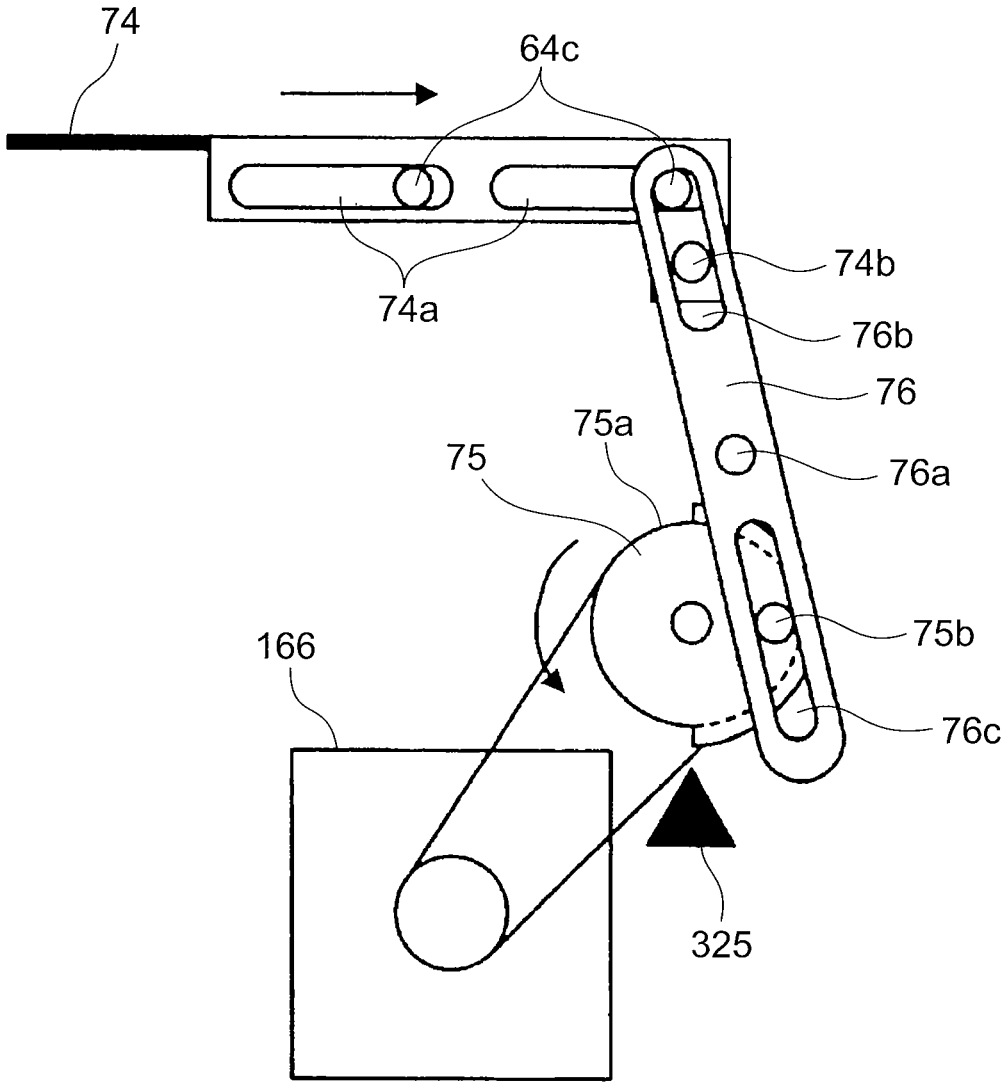
FIG. 11 is a view to describe an operation of the moving mechanism of the fold plate to which the embodiment is applied, and shows a state before entering into a folding operation at the center.
Figure 12:
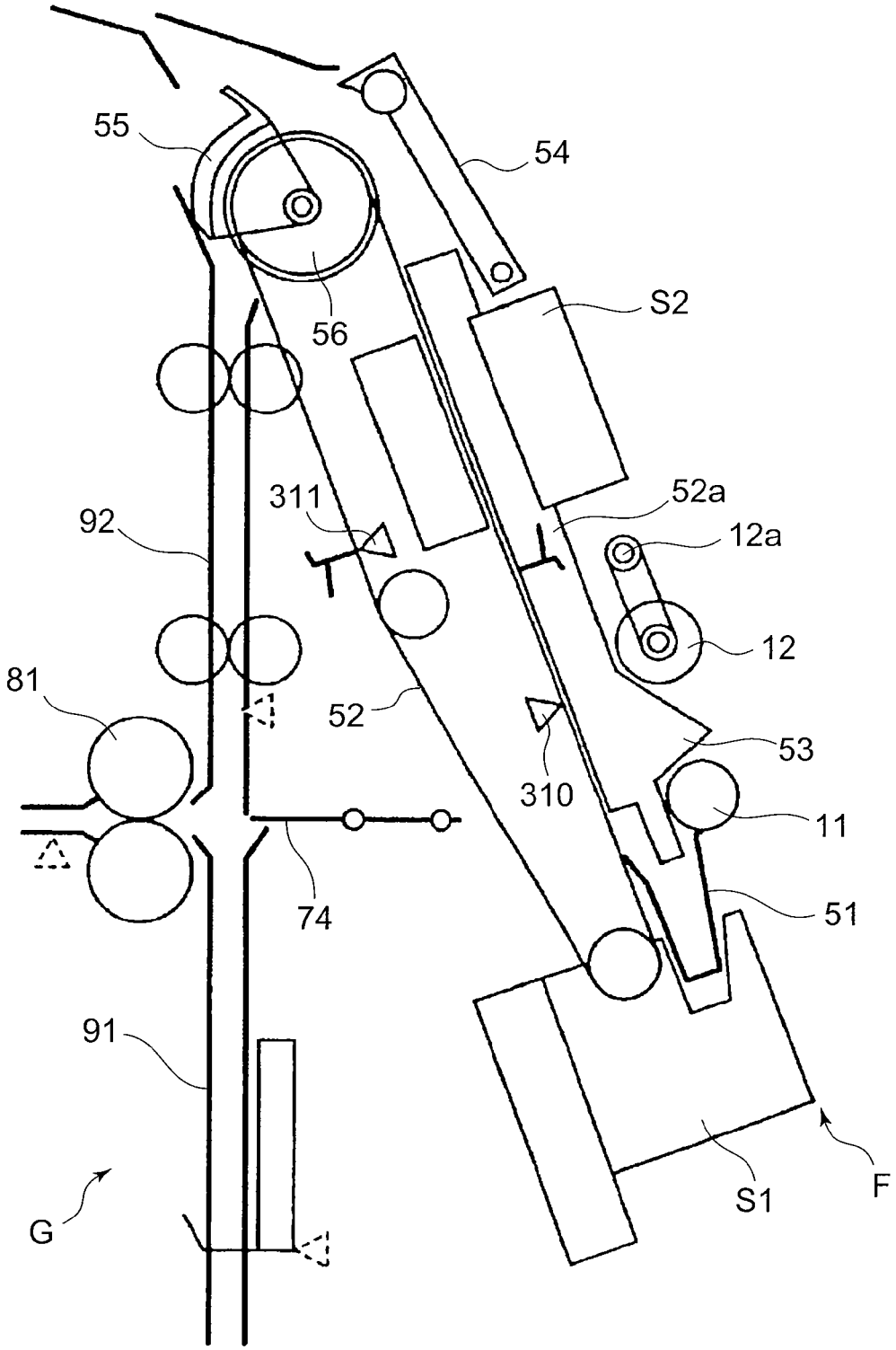
FIG. 12 is a view showing a staple processing tray and a fold processing tray to which the embodiment is applied.

FIG. 10 and FIG. 11 are views, each describing an operation of a moving mechanism of a fold plate 74 for center folding.

The fold plate 74 is supported in such a manner that each of elongate slots 74*a* formed in the fold plate 74 is movably received in one of two pins 64*c* studded on each of the front and rear side walls 64*a* and 64*b*. In addition, a pin 74*b* studded on the fold plate 74 is movably received in an elongate slot 76*b* formed in a link arm 76, and the link arm 76 swings about a fulcrum 76*a*, causing the fold plate 74 to reciprocate in the right-and-left direction. That is, a pin 75*b* studded on a fold plate cam 75 is movably received in an elongate slot 76*c* formed in the link arm 76, and the link arm 76 swings in accordance with the rotation movement of the fold plate cam 75, and in response to this movement, the fold plate 74 reciprocates in the direction perpendicular to a lower guide plate 91 and an upper guide plate 92.

The fold plate cam 75 is rotated in the direction of an arrow shown in FIG. 10 by a fold plate motor 166. The stop position of the fold plate cam 75 is determined by sensing both end portions of a semicircular interrupter portion 75*a* with a fold plate HP sensor 325.

FIG. 10 shows the home position of the fold plate 74 where the fold plate 74 is fully retracted from the sheet stack housing range of the fold processing tray G. When the fold plate cam 75 is rotated in the direction of an arrow, the fold plate 74 is moved in the direction of the arrow and enters the sheet stack housing range of the fold processing tray G. FIG. 11 shows a position where the fold plate 74 pushes the center of the sheet stack on the fold processing tray G into the nip between the fold roller pair 81. When the fold plate cam 75 is rotated in the direction of an arrow, the fold plate 74 moves in the direction of the arrow and thereby retracts from the sheet stack housing range of the fold processing tray G.

Next, the reinforce roller unit 400 will be described. As shown in FIG. 1, the reinforce roller unit 400 is provided on the path H between the fold roller pair 81 and an outlet roller pair 83. The sheet stack which has been folded by the fold plate 74 is pushed into the nip of the fold roller pair 81 and folded, and then the fold thereof is reinforced by the reinforce roller unit 400.

Figure 13:
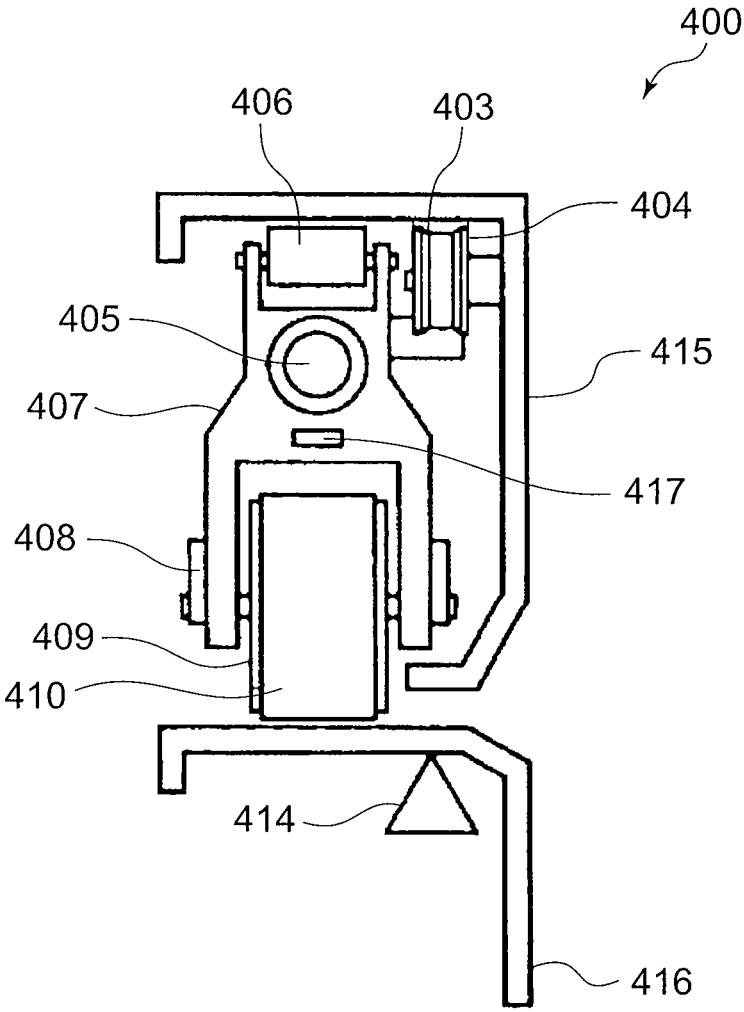
FIG. 13 is a front view of a reinforce roller unit to which the embodiment is applied.
Figure 14:
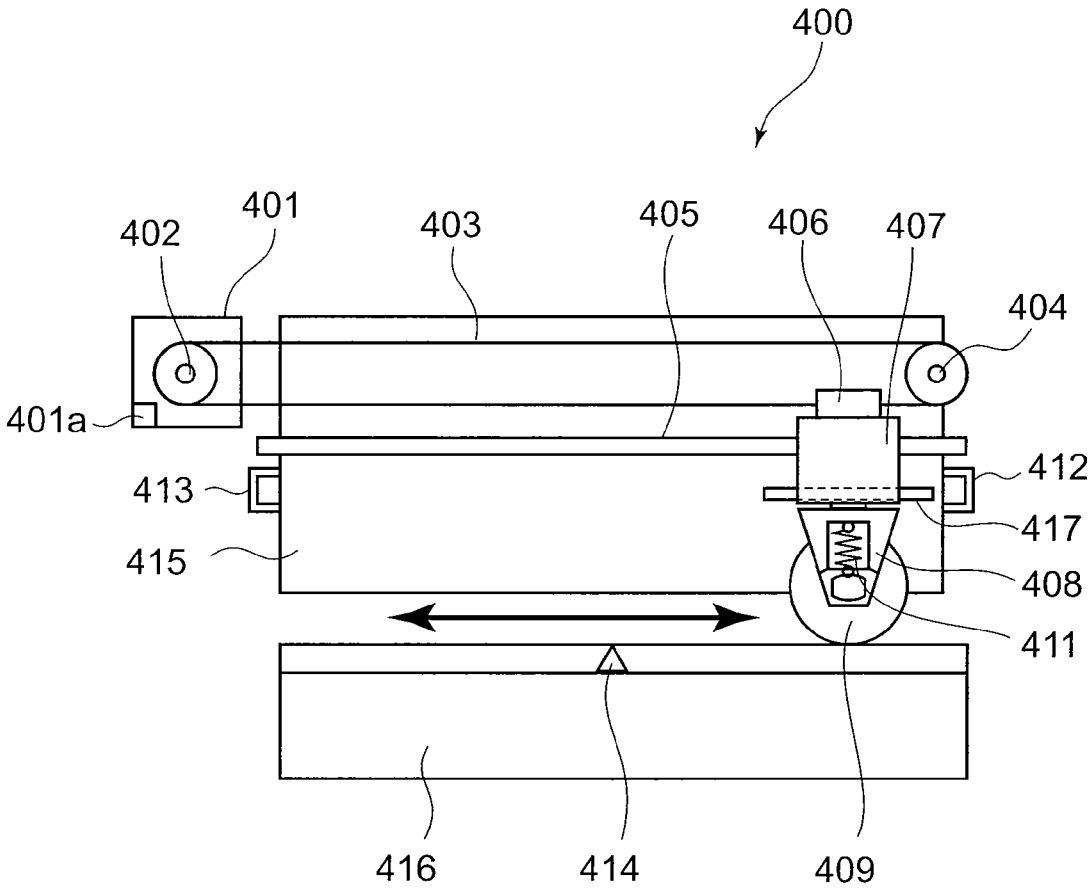
FIG. 14 is a side view of the reinforce roller unit to which the embodiment is applied.

As shown in a plan view of FIG. 13 and a side view of FIG. 14, the reinforce roller unit 400 has a reinforce roller 409, a support mechanism of the reinforce roller 409, and a drive mechanism of the reinforce roller 409. The drive mechanism of the reinforce roller 409 includes a drive pulley 402, a driven pulley 404, an endless timing belt 403 which is passed over both the pulleys 402 and 404, a pulse motor 401 for driving the timing belt 403 to rotate, and a halt detecting sensor 401*a* to sense a halt of the rotation of the pulse motor 401.

The support mechanism of the reinforce roller 409 includes a support portion 407 which is connected with and moves integrally with the timing belt 403, a guide portion 405 to regulate the moving direction on which the support portion 407 slides, an upper guide plate 415 which extends to the opposite side of the reinforce roller 409 of the support portion 407, regulates the tilt of the reinforce roller 409, and prevents the guide portion 405 from bending, a roller support portion 408, and a biasing member 411 as a elastically biasing means for elastically biasing the reinforce roller 409 toward the folding direction of the sheet stack (downward in FIG. 13, FIG. 14). The support mechanism is arranged in the direction perpendicular to the sheet conveying direction, and the drive mechanism causes the reinforce roller 409 to move inside the support mechanism in the direction in which the support mechanism is arranged.

The rotation driving force of the pulse motor 401 is transferred to the support portion 407 connected with the timing belt 403, via the timing belt 403 which is passed over the drive pulley 402 and the driven pulley 404, and the support portion 407 is guided by the guide portion 405 and moves while sliding in the thrust direction of the guide member 405. A bend-preventing portion 406 is provided between the support portion 407 and the upper guide plate 415, and is rotatably supported to the support portion 407, and being roller-shaped, the bend-preventing portion 406 can move integrally with the support portion 407 in the axial direction of the guide portion 405. The reinforce roller 409 is arranged between the support portion 407 and a lower guide plate 416, and a friction portion 410 is fitted on the outer circumference of the reinforce roller 409.

The rotation axis of reinforce roller 409 is supported by the roller support portion 408, and the roller support portion 408 is supported in such a manner as to be movable in the up-and-down direction in sliding contact with the support portion 407. In addition, the roller support portion 408 is pressurized from the support portion 407 toward the lower guide plate 416 by the biasing member 411. In this configuration, the reinforce roller 409 can move in the thrust direction of the guide portion 405 integrally with the support portion 407, and during this time, the reinforce roller 409 is constantly pressurized toward the lower guide plate 416 by the biasing member 411, and can move in the up-and-down direction.

In addition, a first position sensor 412 and a second position sensor 413 are provided at opposite sides in the thrust direction of the guide portion 405, as a sensing means for sensing the position of the support portion 407, respectively. When a detecting plate 417 provided in the support portion 407 comes at positions where the first position sensor 412 and the second position sensor 413 can respectively sense the detecting plate 417, the first and the second position sensors 412, 413 sense the support portion 407. The first and the second position sensors 412, 413 are each composed of a light emitting device and a light receiving element arranged facing this, and senses the existence of the support portion 407 when the detecting plate 17 blocks the light from the light emitting device to the light receiving element. The reinforce roller 409 is moved by the support portion 407 between a position where the first position sensor 412 senses the detecting plate 417 (hereinafter, referred to as a first position) and a position where the second position sensor 413 senses it (hereinafter, referred to as a second position). The reciprocal movement of the reinforce roller 409 between the first position and the second position is performed as a reinforcing operation. In addition, a sheet stack sensor 414 senses a sheet stack conveyed to the reinforce roller unit 400.

Figure 15:
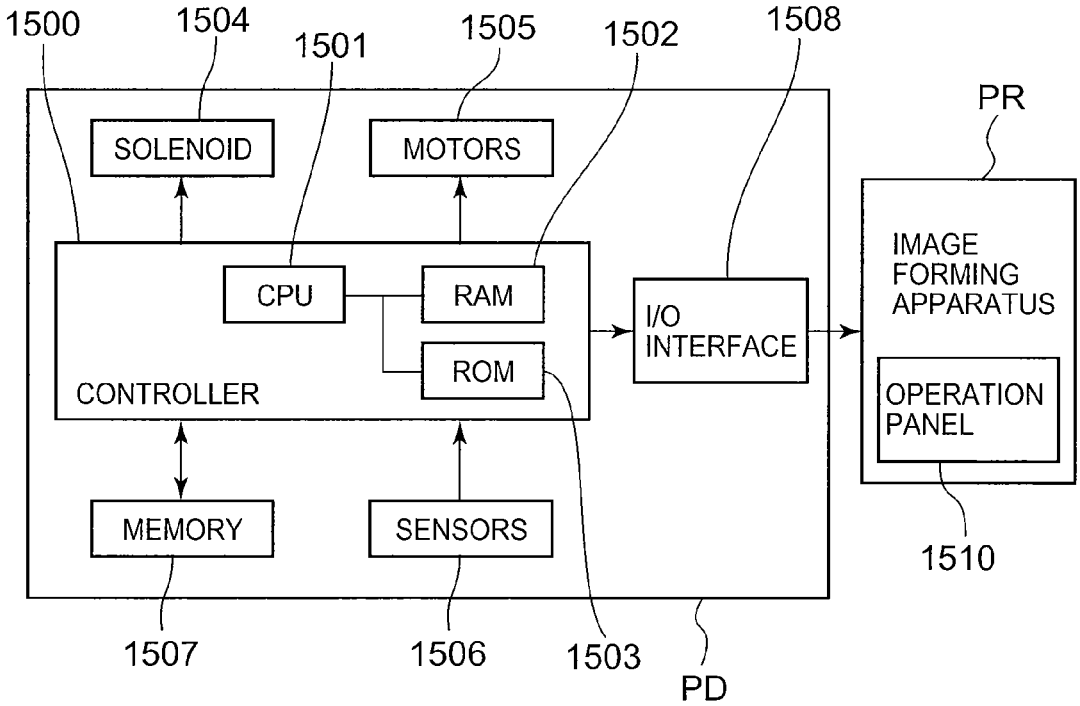
FIG. 15 is a block diagram showing a control of a sheet processing apparatus to which the embodiment is applied.

FIG. 15 is a block diagram showing a control of an image forming system according to the present embodiment. The finisher PD has a controller 1500, a solenoid 1504, motors 1505, sensors 1506, a memory 1507, and an I/O interface 1508 to assume input/output of information with external devices. The information is exchanged between the finisher PD and the image forming apparatus PR via the I/O interface 1508. The image forming apparatus PR has an operation panel 1510.

The control unit 1500 has a CPU (Central Processing Unit) 1501, a RAM (Random Access Memory) 1502, and a ROM (Read Only Memory) 1503. The CPU 1501 is a processor to control the whole control unit 1500. The RAM 1502 is a memory to temporarily store data for operation or to store data for reference. The ROM 1503 is a nonvolatile memory in which the control program and control data so as to control the finisher PD are stored. The CPU 1501 operates based on the control program stored in the ROM 1502, and thereby various processings and various functions are realized. In addition, the CPU 1501 has been used as the processor, but the kind of the processor is not limited to this.

The motors 1505 includes the pulse motor 401 of the reinforce roller unit 400 and indicates various motors to drive respective portions of the finisher PD. The motors 1505 and the solenoid 1504 are driven by commands from the control unit 1500, respectively.

The sensors 1506 includes the inlet sensor 301, the shift outlet sensor 303, the sheet surface sensor 330, the guide plate sensor 331, the sheet sensor 310, the HP sensor 311, the stapler HP sensor 312, the staple changing position sensor 313, the fold plate HP sensor 325, the halt detecting sensor 401*a*, the first position sensor 412, the second position sensor 413 and the sheet stack sensor 414, for example, and signals from the respective sensors are inputted to the CPU 1501.

The memory 1507 stores an accumulation of the number of halts of the pulse motor 401 when the reinforcement is retried with the reinforce roller unit 400 which will be described below. After a signal indicating a halt of the pulse motor 401 is sent from the halt detecting sensor 401*a* to the control unit 1500, the accumulation of the number of halts is stored in the memory 1507. This accumulation of the number of halts of the pulse motor 401 is reset when the reinforcing operation is finished normally.

The operation panel 1510 provided in the image forming apparatus PR functions as a display portion and an input portion. That is, they are respectively a display to show a notification to a user and a user interface to which an operation instruction from a user is inputted. The operation panel 1510 is a display device with a built-in touch panel, for example, and has touch keys and so on of a display portion such as an LCD (Liquid Crystal Display), for example. The user can confirms the notification and can input an operation instruction with the operation panel 1501. In addition, the operation panel 1510 may be provided in the finisher PD.

Figure 16:
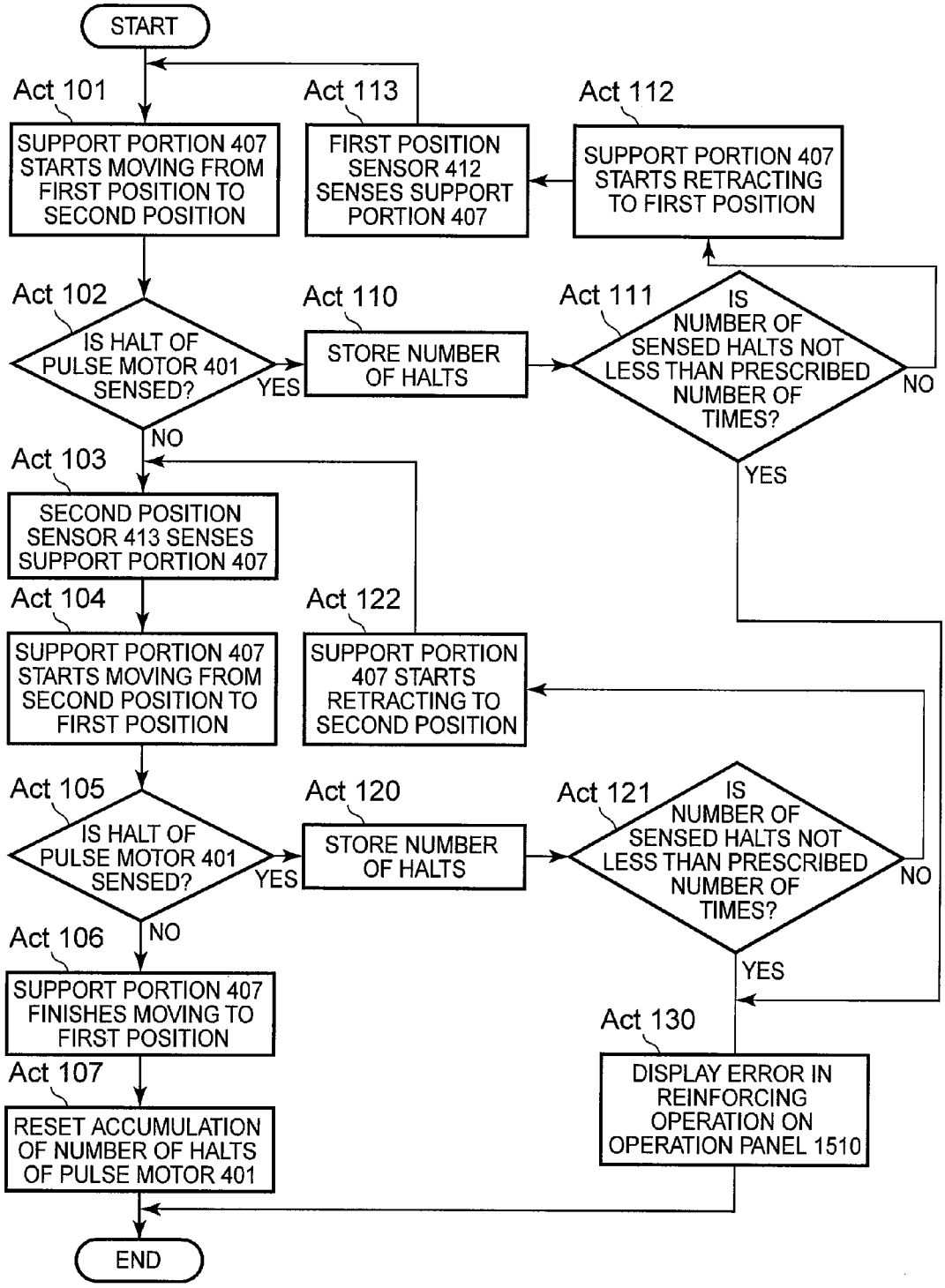
FIG. 16 is a flow chart relating to retrying the reinforcement in a sheet processing apparatus in a first embodiment.

FIG. 16 is a flow chart relating to a control for retrying reinforcement according to the present embodiment.

When a reinforcing operation is started, the control unit 1500 makes the support portion 407 for moving the reinforce roller 409 start moving from the first position to the second position (Act 101). Next, the control unit 1500 judges whether or not a halt of the pulse motor 401 to move the support portion 407 is sensed by the halt detecting sensor 401*a* on the way where the support portion 407 moves from the first position to the second position (Act 102). That the pulse motor 401 stops on the way where the support portion 407 moves from the first position to the second position indicates that the reinforce roller 409 stops between the first position and the second position and thereby an error in the reinforcing operation is generated.

The halt of the pulse motor 401 is sensed and that the support portion 407 which moves integrally with the reinforce roller 409 stops on the way from the first position to the second position is judged (YES in Act 102), the reinforcing operation is retried. Because that the pulse motor 401 stops again is thought of during this retrying operation, the control unit 1500 adds the number of sensed halts of the pulse motor 401 and stores it in the memory 1507 (Act 110). The control unit 1500 judges whether or not the accumulated number of the sensed halts of the pulse motor 401 which is stored in the memory 1507 is not less than a prescribed number of times (Act 111). The prescribed number of times for the accumulated number of the sensed halts of the pulse motor 401 is set approximately 2~3 times, for example. This is because, if the prescribed number of times is set large, while retrying the reinforcement is repeated the print job may fall into arrears.

If that the number of the sensed halts of the pulse motor 401 is not less than the prescribed number of times is judged (YES in Act 111), the control unit 1500 displays an error in the reinforcing operation on the operation panel 1510 (Act 130). To display the error on the operation panel 1510 urges the user to jam processing and so on.

If that the number of the sensed halts of the pulse motor 401 is less than the prescribed number of times is judged in Act 111 (NO in Act 111), the control unit 1500 makes the support portion 407 start retracting to the first position (Act 112). Then, if the first position sensor 412 senses the support portion 407 (Act 113), the control unit 1500 judges that retracting the support portion 407 to the first position has been finished. Then, the processing returns to Act 101 to start retrying the reinforcing operation, and the control unit 1500 makes the support portion 407 to be moved from the first position to the second position.

If in Act 102, the halt of the pulse motor 401 is not sensed (NO in Act 102), and the second position sensor 413 senses the support portion 407 (Act 103), the movement of the support portion 407 to the second position is finished. And, the control unit 1500 makes the support portion 407 start moving from the second position to the first position (Act 104).

Next, the control unit 1500 judges whether or not a halt of the pulse motor 401 to move the support portion 407 is sensed by the halt detecting sensor 401*a* on the way where the support portion 407 moves from the second position to the first position (Act 105). The halt of the pulse motor 401 is detected and that the support portion 407 which moves integrally with the reinforce roller 409 stops on the way from the second position to the first position is judged (YES in Act 105), the control unit 1500 adds the number of the sensed halts of the pulse motor 401 and stores it in the memory 1507 (Act 120). The control unit 1500 judges whether or not the accumulated number of the sensed halts of the pulse motor 401 which is stored in the memory 1507 is not less than the prescribed number of times (Act 121).

If that the number of the sensed halts of the pulse motor 401 is not less than the prescribed number of times is judged (YES in Act 121), the control unit 1500 displays an error in the reinforcing operation on the operation panel 1510 (Act 130). To display the error on the operation panel 1510 urges the user to the jam processing and so on.

If that the number of the sensed halts of the pulse motor 401 is less than the prescribed number of times is judged in Act 121 (NO in Act 121), the control unit 1500 makes the support portion 407 start retracting to the second position (Act 122). Then, if the second position sensor 413 senses the support portion 407 (Act 103), the control unit 1500 judges that retracting the support portion 407 to the second position has been finished. Then, in order to start retrying the reinforcing operation, the control unit 1500 makes the support portion 407 to be moved from the second position to the first position (Act 104).

If in Act 105, the halt of the pulse motor 401 is not sensed (NO in Act 105), and the first position sensor 412 senses the support portion 407 (Act 106), the movement of the support portion 407 to the first position is finished. That is, the reinforcement is completed. Then, the control unit 1500 resets the accumulated number of the sensed halts of the pulse motor 401 which is stored in the memory 1507 (Act 107), and the processing is completed.

In addition, in the above-described embodiment, whether or not the support portion 407 has stopped during the reinforcing operation is sensed by the halt detecting sensor 401*a* of the pulse motor 401, but a sensing method of a halt of the support portion 407 is not limited to this. In case that the movement of the support portion 407 from the first position to the second position, or the movement thereof from the second position to the first position is not completed in a prescribed time, for example, that the support portion 407 stops during the reinforcing operation may be assumed.

Specifically, in case that the second position sensor 413 does not sense the support portion 407 within a prescribed time after the first position sensor 412 sensed the support portion 407 at the time of moving the support portion 407 from the first position to the second position, or in case that the first position sensor 412 does not sense the support portion 407 within a prescribed time after the second position sensor 413 sensed the support portion 407 at the time of moving the support portion 407 from the second position to the first position, that the support portion 407 stops during the movement can be assumed.

As described above, when a halt of the pulse motor is sensed during a reinforcing operation, an instruction to release an error is not outputted to a user immediately. But if the number of the halts of the pulse motor is within a prescribed number of times, the reinforcing operation is retried, and thereby the reinforcing operation can be done immediately in case that the error processing by the user is not required, and as a result the job can be performed smoothly. In addition, the user is not required to confirm an error every time a reinforcing operation stops, and thereby a burden to the user can be reduced.

Second Embodiment

A second embodiment will be described using FIG. 17 to FIG. 20. Hereinafter, the same symbols are used for the same portions as in the first embodiment, and only the characterizing portions of the present embodiment will be described.

Figure 17:
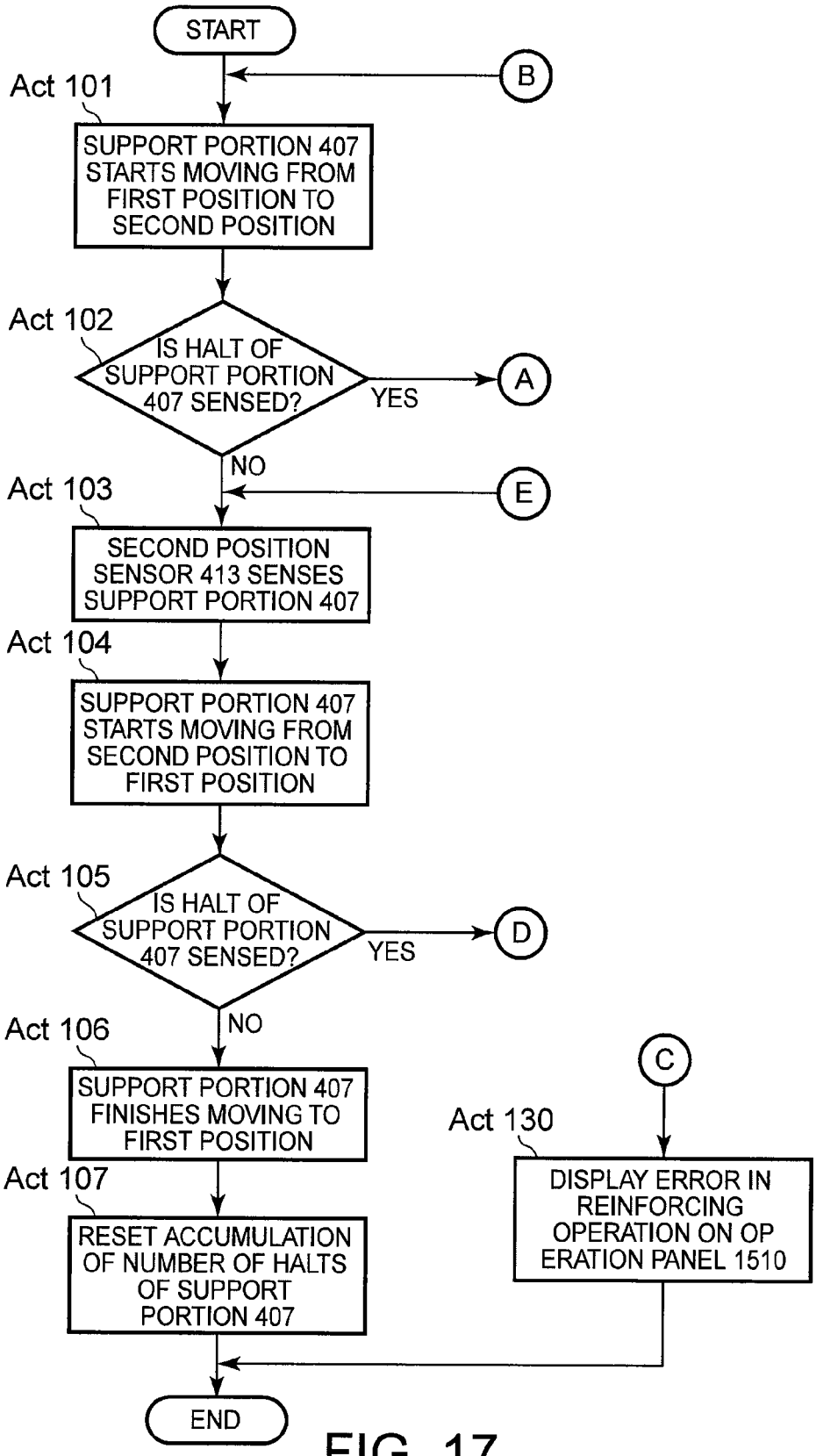
FIG. 17 is a flow chart relating to retrying the reinforcement in a sheet processing apparatus in a second embodiment.
Figure 18:
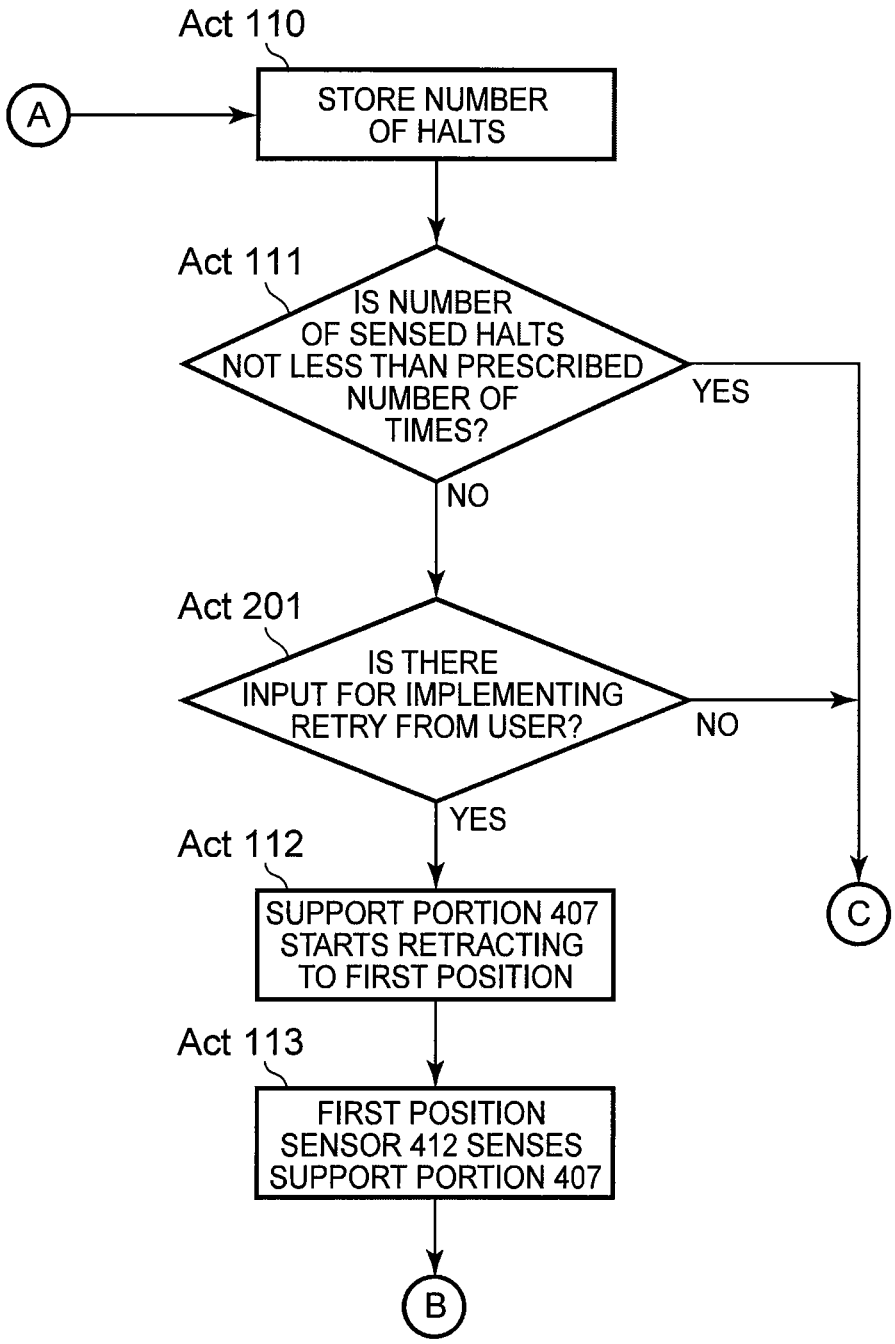
FIG. 18 is a flow chart relating to retrying the reinforcement in the sheet processing apparatus in the second embodiment.

The present embodiment asks for a permission from a user before retrying the reinforcing operation, and thereby is an embodiment which can reflect more the user's will. FIG. 17 is a flow chart relating to a control for retrying a reinforcing operation according to the present embodiment. The same symbols are given to the portions doing the same operations as in the flow chart of the first embodiment in FIG. 16, and their description will be omitted.

Figure 20:
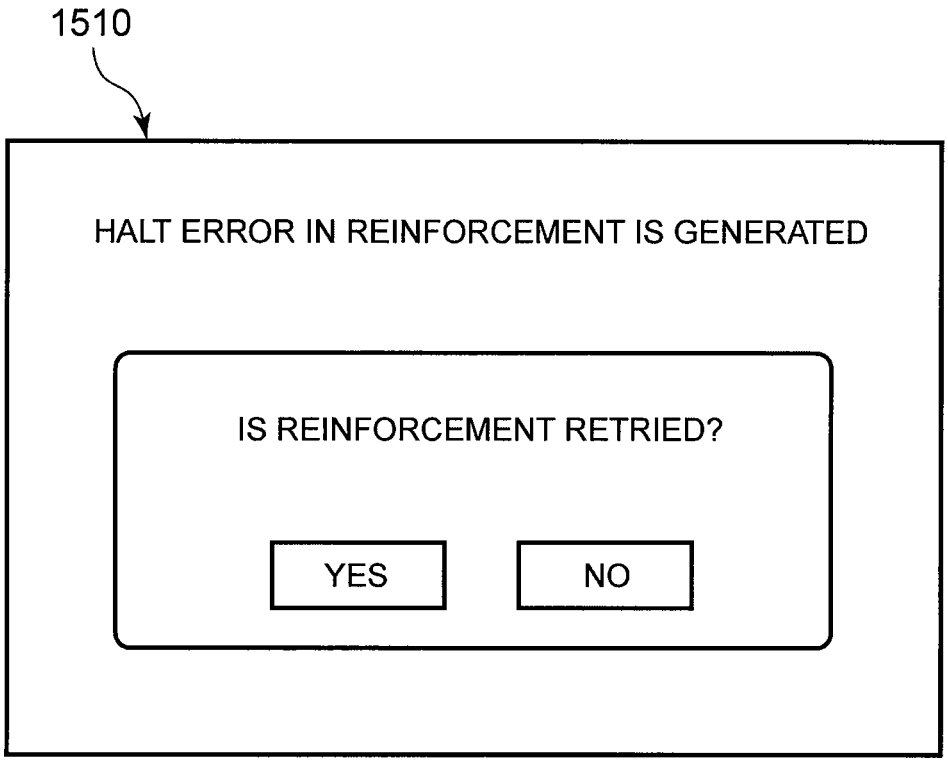
FIG. 20 is an example of a screen display on an operation panel in the second embodiment.

If that the number of the sensed halts of the pulse motor 401 is less than the prescribed number of times is judged in Act 111 (NO in Act 111), whether the reinforcing operation is retried is displayed on the operation panel 1510, to thereby urge the user to input whether or not the reinforcing operation is retried (Act 201). FIG. 20 is an example of a screen displayed on the operation panel 1510.

When the control unit 1500 confirms a user's input for implementing a retry via the operation panel 1510 (YES in Act 201), makes the support portion 407 start retracting to the first position (Act 112). Subsequently, the operations of Act 113 or later will be performed.

If the user's input for implementing the retry is not confirmed in Act 201 (NO in Act 201), the processing goes to Act 130 in FIG. 17, and the control unit 1500 makes the operation panel 1510 display an error in the reinforcement.

Figure 19:
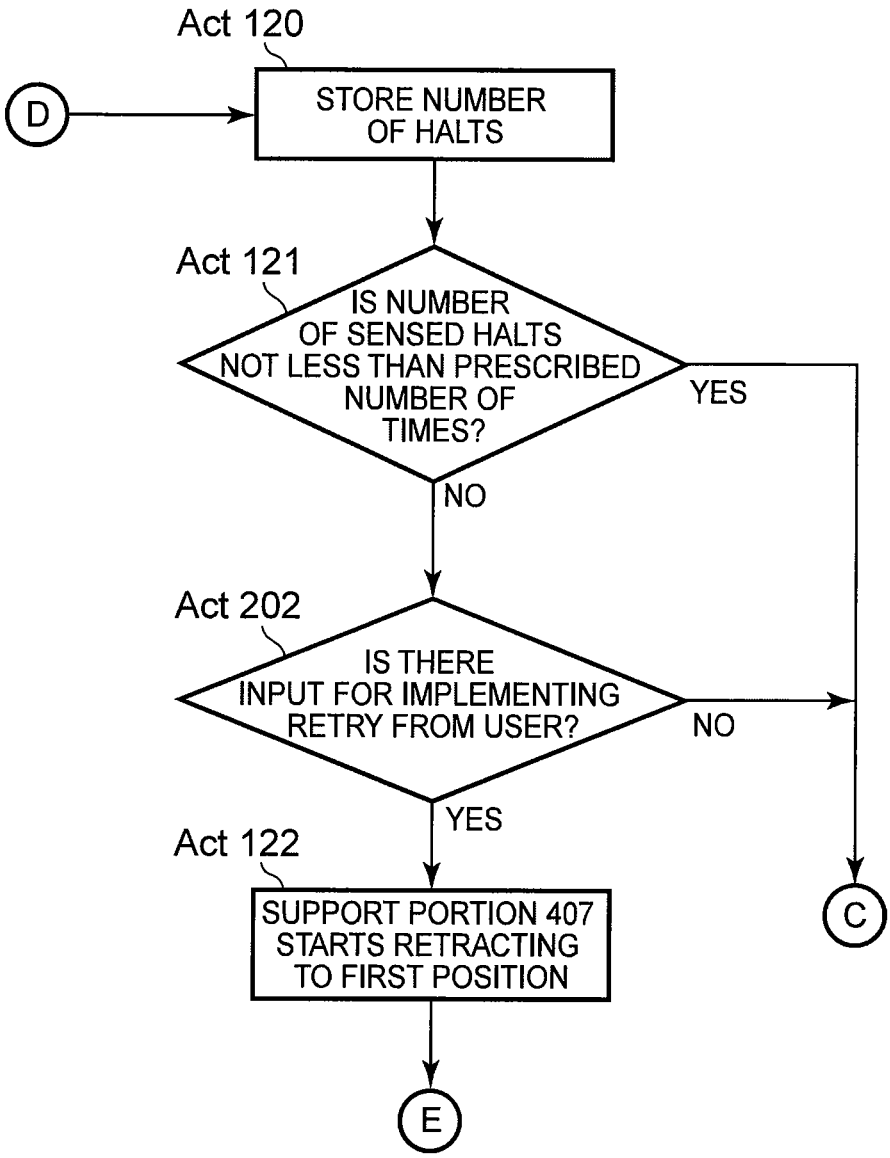
FIG. 19 is a flow chart relating to retrying the reinforcement in the sheet processing apparatus in the second embodiment.

If YES in Act 105 and the operations to Act 121 in FIG. 19 are performed, and that the number of the halts is less than the prescribed number of times is judged in Act 121 (NO in Act 121), whether the reinforcing operation is retried is displayed on the operation panel 1510 to thereby urge the user to input whether or not the reinforcement is retried (Act 202). In this time too, the screen shown in FIG. 20, for example is displayed on the operation panel 1510 in the same manner as in Act 201.

If the control unit 1500 confirms the user's input for implementing the retry (YES in Act 202), makes the support portion 407 start retracting to the first position (Act 122). Subsequently, the operations of Act 103 or later will be performed.

If the user's input for implementing the retry is not confirmed in Act 202 (NO in Act 202), the processing goes to Act 130, and the control unit 1500 makes the operation panel 1510 display an error in the reinforcement.

According to the above-described embodiment, when an error is generated in the reinforcement, the user's will whether or not the retry is performed can be reflected. When the user does not hope to retry the reinforcement and want to release the error immediately, the present embodiment is effective.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a roller unit having a reinforce roller which moves along a fold of a sheet perpendicular to the sheet conveying direction and thereby further reinforces the fold by the reinforce roller; and a control unit which counts the number of halts of the roller unit generated during the reinforcing operation of the sheet, and in case that the counted number of the halts of the roller unit is less than a prescribed number of times, makes the roller unit to be moved to a retract position and then makes the roller unit to be driven again to perform the reinforcing operation.

2. The apparatus of claim 1, wherein:

in case that the counted number of the halts of the roller unit is not less than the prescribed number of times, an error of the reinforcing operation is displayed on a display.

3. The apparatus of claim 2, further comprising a memory to store the counted number of the halts, wherein:

the control unit resets the number of the halts of the roller unit stored in the memory when the reinforcing operation of the sheet by the roller unit is finished.

4. The apparatus of claim 3, wherein:

the roller unit performs the reinforcing operation for the sheet with a movement from a first position to a second position and with a movement from the second position to the first position, here, the first and second positions being separate to each other in a direction perpendicular to the sheet conveying direction; and the control unit makes the roller unit to be moved to the first position assuming the first position as the retract position when the roller unit halts during the movement from the first position to the second position, and makes the roller unit to be moved to the second position assuming the second position as the retract position when the roller unit halts during the movement from the second position to the first position.

5. The apparatus of claim 3, further comprising:

a motor to drive the roller unit; and a halt detecting sensor to sense the halt of the motor;

wherein the control unit senses the halt of the roller unit by a signal of the halt of the motor with the halt detecting sensor.

6. The apparatus of claim 4, further comprising;

a first position sensor to sense that the roller unit is present at the first position; and a second position sensor to sense that the roller unit is present at the second position;

wherein the control unit judges that the roller unit halts during the reinforcing operation, in case that when the roller unit is moved from the first position to the second position, the second position sensor does not sense the roller unit within a prescribed time after the first position sensor sensed the roller unit, or in case that when the roller unit is moved from the second position to the first position, the first position sensor does not sense the roller unit within a prescribed time after the second position sensor sensed the roller unit.

7. The apparatus of claim 2, wherein:

in case that the number of the continuous halts during the movement of the roller unit is less than a prescribed number of times, the control unit makes the roller unit to be driven to perform again the reinforcing operation when the control unit receives an input of an instruction to perform again the reinforcing operation from a user after the roller unit halted.

8. An image forming system, comprising:

an image forming apparatus to form an image on a sheet based on inputted image information; and a sheet processing apparatus, including:

a fold roller pair to fold the sheet on which the image has been formed by the image forming apparatus;

a roller unit having a reinforce roller to reinforce the fold of the sheet which has been folded by the fold roller pair which moves along the fold of the sheet perpendicular to a sheet conveying direction and thereby further reinforces the fold by the reinforce roller; and a control unit which counts the number of halts of the roller unit generated during the reinforcing operation of the sheet, and in case that the counted number of the halts of the roller unit is less than a prescribed number of times, makes the roller unit to be moved to a retract position and then makes the roller unit to be driven again to perform the reinforcing operation.

9. The system of claim 8, further comprising:

a display portion to give notice to a user; and an input portion to which the user inputs an instruction;

wherein in case that the number of the halts continuously sensed with a halt detecting sensor during the movement of the roller unit is less than a prescribed number of times, the control unit displays an indication on the display portion to urge an input whether or not the reinforcing operation is tried after the roller unit halted, and makes the roller unit to be driven to perform again the reinforcing operation when the control unit receives an input of the instruction to perform again the reinforcing operation via the input portion.

10. The system of claim 8, wherein:

the sheet processing apparatus further comprising a memory to store the counted number of the halts, and;

the control unit resets the number of the halts of the roller unit stored in the memory when the reinforcing operation of the sheet by the roller unit is finished.

11. The system of claim 8, wherein:

the roller unit performs the reinforcing operation for the sheet with a movement from a first position to a second position and with a movement from the second position to the first position, here, the first and second positions being separate to each other in a direction perpendicular to a sheet conveying direction; and the control unit makes the roller unit to be retracted to the first position assuming the first position as the retract position when the roller unit halts during the movement from the first position to the second position, and makes the roller unit to be retracted to the second position assuming the second position as the retract position when the roller unit halts during the movement from the second position to the first position.

12. The system of claim 8, further comprising:

a motor to drive the roller unit; and a halt detecting sensor to sense the halt of the motor;

wherein the control unit senses the halt of the roller unit by a signal of the halt of the motor with the halt detecting sensor.

13. The system of claim 11, further comprising:

a first position sensor to sense that the roller unit is present at the first position; and a second position sensor to sense that the roller unit is present at the second position.

14. The system of claim 13, wherein:

the control unit judges that the roller unit halts during the reinforcing operation, in case that when the roller unit is moved from the first position to the second position, the second position sensor does not sense the roller unit within a prescribed time after the first position sensor sensed the roller unit, or in case that when the roller unit is moved from the second position to the first position, the first position sensor does not sense the roller unit within a prescribed time after the second position sensor sensed the roller unit.

15. The system of claim 12, wherein:

in case that the number of the continuous halts during the movement of the roller unit is less than a prescribed number of times, the control unit makes the roller unit to be driven to perform again the reinforcing operation when the control unit receives an input of an instruction to perform again the reinforcing operation from a user after the roller unit halted.

16. A sheet processing method by a sheet processing apparatus having a roller unit with a reinforce roller to reinforce the fold of a sheet stack which has been folded, comprising:

reinforcing the fold of the sheet stack with the reinforce roller by driving the roller unit along the fold;

counting the number of halts of the roller unit in case that the roller unit halts during a reinforcing operation of the sheet with the reinforce roller and the reinforcing operation is performed again;

making the roller unit to be moved to a retract position when the roller unit halts in case that the counted number of the halts of the roller unit is less than a prescribed number of times; and making the roller unit to be driven again to perform the reinforcing operation with the reinforce roller after the roller unit was moved to the retract position.

17. The method of claim 16, wherein:

the number of the halts of the roller unit stored is reset when the reinforcing operation of the sheet by the reinforce roller is finished with a movement of the roller unit.

18. The method of claim 16, wherein:

the reinforcing operation is performed for the sheet by a movement of the roller unit from a first position to a second position, here, the first and second positions are separate to each other in the direction perpendicular to the sheet conveying direction;

the reinforcing operation is performed for the sheet by a movement of the roller unit from the second position to the first position;

the roller unit is moved to the first position assuming the first position as the retract position when the roller unit halts during the movement from the first position to the second position; and the roller unit is moved to the second position assuming the second position as the retract position when the roller unit halts during the movement from the second position to the first position.

19. The method of claim 18, further comprising:

sensing that the roller unit is present at the first position with a first position sensor; and sensing that the roller unit is present at the second position with a second position sensor.

20. The method of claim 19, wherein:

that the roller unit halts during the reinforcing operation is judged, in case that when the roller unit is moved from the first position to the second position, the second position sensor does not sense the roller unit within a prescribed time after the first position sensor sensed the roller unit, or in case that when the roller unit is moved from the second position to the first position, the first position sensor does not sense the roller unit within a prescribed time after the second position sensor sensed the roller unit.

* * * * *